United States Patent [19]

Friedman et al.

[11] Patent Number: 4,571,294

[45] Date of Patent: Feb. 18, 1986

[54] PROCESS FOR EXTRACTING HYDROCARBONS FROM HYDROCARBON BEARING ORES

[75] Inventors: Robert H. Friedman; Bertram E. Eakin, both of Houston, Tex.

[73] Assignee: Getty Oil Company, Houston, Tex.

[21] Appl. No.: 627,188

[22] Filed: Jul. 2, 1984

[51] Int. Cl.[4] ..... C10G 1/04

[52] U.S. Cl. ..... 208/11 LE

[58] Field of Search ..... 208/11 LE, 8 LE

[56] References Cited

U.S. PATENT DOCUMENTS

| | | | |
|---|---|---|---|
| 3,856,474 | 12/1974 | Pittman et al. | 585/11 LE |
| 4,005,005 | 1/1977 | McCollum et al. | 208/11 |
| 4,029,568 | 6/1977 | Pittman et al. | 585/11 LE |
| 4,151,068 | 4/1979 | McCollum et al. | 208/11 |
| 4,156,463 | 5/1979 | Hall | 166/272 |
| 4,341,619 | 7/1982 | Poska | 208/11 |
| 4,390,411 | 6/1983 | Scinta et al. | 208/11 |
| 4,397,736 | 8/1983 | Low | 208/11 |
| 4,461,695 | 7/1984 | Williams | 585/11 LE |

*Primary Examiner*—D. E. Gantz
*Assistant Examiner*—A. Pal
*Attorney, Agent, or Firm*—Arnold, White & Durkee

[57] ABSTRACT

Hydrocarbons may be recovered from hydrocarbon-bearing ore by reducing the ore to small particles, forming the reduced ore into pellets, setting the pellets, and then contacting the pellets with an extracting solvent. The extracted hydrocarbons usually have an ash content of less than about three weight percent, and the spent pellets usually retain less than 0.75 pounds of solvent per pound of spent pellets.

34 Claims, 2 Drawing Figures

PROCESS FOR EXTRACTING HYDROCARBONS FROM HYDROCARBON BEARING ORES

BACKGROUND OF THE INVENTION

There is provided an improved process for extracting hydrocarbons and the like from a hydrocarbon-bearing ore and more particularly an improved process for extracting hydrocarbons from hydrocarbon-bearing ores such as diatomaceous earths and the like by forming the ore into pellets.

Many earth formations contain deposits having substantial amounts of hydrocarbons. Oil-bearing diatomaceous earths, tar sands and other deposits contain varying degrees of hydrocarbons. A variety of extraction processes for removal of oil from such ores have been proposed. These may be divided into several categories including pyrolysis or coking, aqueous extraction and solvent extraction. A number of these processes are described in U.S. patent application Ser. No. 450,265 entitled "Extraction Process and Apparatus for Hydrocarbon-Containing Ores."

As noted in Perry's Chemical Engineers Handbook (4th Edition, 1969) page 8–59 et. seq. (hereinafter Perry's) the building up of solid masses of particles from small particulates has long been used as a means of creating definite and useful shapes. As indicated in Perry's there are numerous reasons for doing this, including the need to reduce dust, to prepare a material so that it will not cake or lump, to densify the material for more convenient storage, to create uniform blends which can be handled without segregation and to prepare the material for further processing such as in briquetting or tableting where high apparent density and freedom from dusting are important. Size enlargement has been used in the sintering, nodulizing or briquetting of some types of ores and the nodulizing, extrusion and pelleting of feeds.

When reduced in size, many hydrocarbon-bearing ores become largely impermeable to liquids. This in turn limits the extent to which an extracting medium can be brought into contact with the hydrocarbon-bearing ore. Various attempts have been made to solve this problem, including by use of continuous stagewise, countercurrent extraction-decantation as described in U.S. Pat. Nos. 4,239,617 and 4,167,470.

Forming the ore into pellets did not initially appear workable, particularly since it was believed that any additive used to form pellets would hinder or prevent extraction and decrease the surface area of the ore exposed to an extracting medium. It was also felt that even if workable to some degree, pellet formation would add process steps and increase energy and equipment costs sufficiently to make its use counter-productive. However, it has been discovered that hydrocarbon-bearing ores such as diatomaceous earth and the like may be advantageously extracted by forming the ore into pellets in the manner claimed herein.

Prior processes also suffer from one or more of several defects or limitations. Thus, prior processes may fail to adequately mate process yields with process energy or materials requirements. For example, some processes using extracting solvents fail to recover a sufficient amount of extracting solvent for reuse in the extracting process. Other processes fail to efficiently recover the extracting solvent. There are also problems associated with the presence of fines including fines removal from product streams. Still other processes produce emulsions, which are difficult and relatively expensive to handle. Yet other processes produce waste products which are likewise difficult to handle, while other processes use equipment which must be specially fabricated for use in the particular process. These and other defects or limitations are minimized if not eliminated by the present inventive method.

SUMMARY OF THE INVENTION

There is provided a process for recovering hydrocarbons from a hydrocarbon-bearing ore which forms a significant amount of fines upon being reduced in size. The ore is first reduced in size to less than about 4 mesh to form a reduced ore. The reduced ore is then formed into ore pellets by combining water or a partially non-aqueous liquid and possibly a binder with the reduced ore. The liquid and the binder are added in sufficient quantities to form ore pellets. The ore pellets may be formed either with water alone, water with a binder, or water with solvent. At least 85% of the pellets have diameters less than 5 mesh but greater than 40 mesh.

The ore pellets which contain a binder are then treated to form extractable ore pellets. Pellets formed with water only, while not as mechanically strong as pellets formed with binder, are already extractable ore pellets. The extractable ore pellets have sufficient consistency so as to be substantially insoluble in an extracting solvent capable of dissolving hydrocarbons from the hydrocarbon-bearing ore. This is done so as to minimize the release of any fines from the pellets. The extractable ore pellets are of sufficient size and surface area so as to facilitate extraction of the hydrocarbons from the extractable pellets upon contacts of the pellets with an extracting solvent.

The extractable pellets are then contacted with an extracting solvent such that the relative velocity of the solvent to the extractable pellets is at least one-half gallon per square foot per minute, and preferably 1.0 to 5.0 gallons per square foot per minute, to thereby extract hydrocarbons from the extractable pellets and form spent pellets. The spent pellets retain less than 0.75 lbs. of extracting solvent per lb. of spent pellets. A hydrocarbon rich solvent stream is formed and includes extracting solvent and extracted hydrocarbons. Extracted hydrocarbons have an ash content of less than about three weight percent.

At least a portion of the extracting solvent is recovered from the spent pellets while the spent pellets are retained in pellet form for subsequent disposal.

The at least partially non-aqueous liquid that can be used to form the ore pellets may include extracting solvent. It may also include water in sufficient quantity to form pellets having a water content in the range of about 20 to 36 weight percent based on the weight of the pellets.

The step of treating the ore pellets may include the step of drying the ore pellets at above about 100° F. such that the extractable pellets have a water content in the range of about 18 to 25 weight percent based on the weight of the pellets.

The ore pellets may be treated by exposing them to sufficient quantities of carbon dioxide or other acidic materials or reacting silicate in the ore pellets with calcium chloride in sufficient quantity to set the pellets.

In one embodiment the extracting solvent may contact the extractable pellets in countercurrent batchwise flow by passing the extracting solvent through successive beds of extractable pellets.

Although the extracted hydrocarbons have an ash content of less than about three weight percent, the process is preferably operated such that the extracted hydrocarbons has an ash content of about less than one weight percent and most preferably under conditions whereby the extracted hydrocarbons have an ash content of less than about 0.2 weight percent.

After extraction extracting solvent is generally recovered from the extracted hydrocarbons. Extracting solvent may then be recycled to contact additional extractable pellets. Extracting solvent may also be recovered from spent pellets by various means, an example of which is by direct steam stripping.

In another embodiment there is provided a process for recovering hydrocarbons from a diatomite ore. The size of the diatomite ore is reduced to less than about 5 mesh, with a significant portion less than about 100 mesh, to form a reduced ore. The reduced ore is then formed into pellets by adding water or an at least partially non-aqueous liquid and a binder comprising an N-type sodium silicate to the reduced ore. The water and binder are added in sufficient quantities to form an ore pellet having about 0.5 to 3.0 weight percent sodium silicate and about 20 to 36 weight percent water.

The ore pellets are then treated by drying the ore pellets at a temperature above about 100° F. to form extractable pellets. The extractable pellets have a weight percent of water in the range of about 6 to 34 percent and a size generally in the range of 5 to 100 mesh.

The extractable pellets are then formed into at least one extractable pellet bed in an extraction zone. An extracting solvent capable of extracting hydrocarbons from the diatomide ore is then passed upwardly through the extractable pellet bed. The extracting solvent is at a temperature of at least 100° F. upon contacting the bed and flows at a rate in the range of about 0.5 to about 10 gallons per square foot per minute through the bed to thereby extract hydrocarbons from the extractable pellets and form spent pellets and a hydrocarbon rich solvent stream. The hydrocarbon rich stream includes extracted hydrocarbons and extraction solvent.

Extraction solvent is then recovered from the hydrocarbon rich solvent stream to form a first extraction solvent recycled stream and a hydrocarbon product stream having an ash content of about less than 3.0 weight percent and preferably less than 1.0 weight percent and most preferably less than 0.2 weight percent.

The flow of extracting solvent is then discontinued through the bed of extractable pellets once at least approximately 75 percent of the hydrocarbons have been recovered. Residual extraction solvent is then drained from the bed of spent pellets such that the spent pellets retain less than about 0.75 lbs. of extracting solvent per pound of spent pellets.

Extraction solvent is then removed from the spent pellets by steam stripping while the spent pellets are retained in pellet form. A second extraction solvent recycle stream is formed as a result.

At least a portion of either or both of the first and second recycle solvent streams are recycled to the extraction zone after removing at least a portion of any water mixed in the portion of the first and second recycle solvent streams so recycled.

There follows a detailed description of one or more embodiments of the present inventive method in conjunction with the foregoing drawings. This description is to be taken by way of illustration rather than limitation.

DETAILED DESCRIPTION

Figure 1:
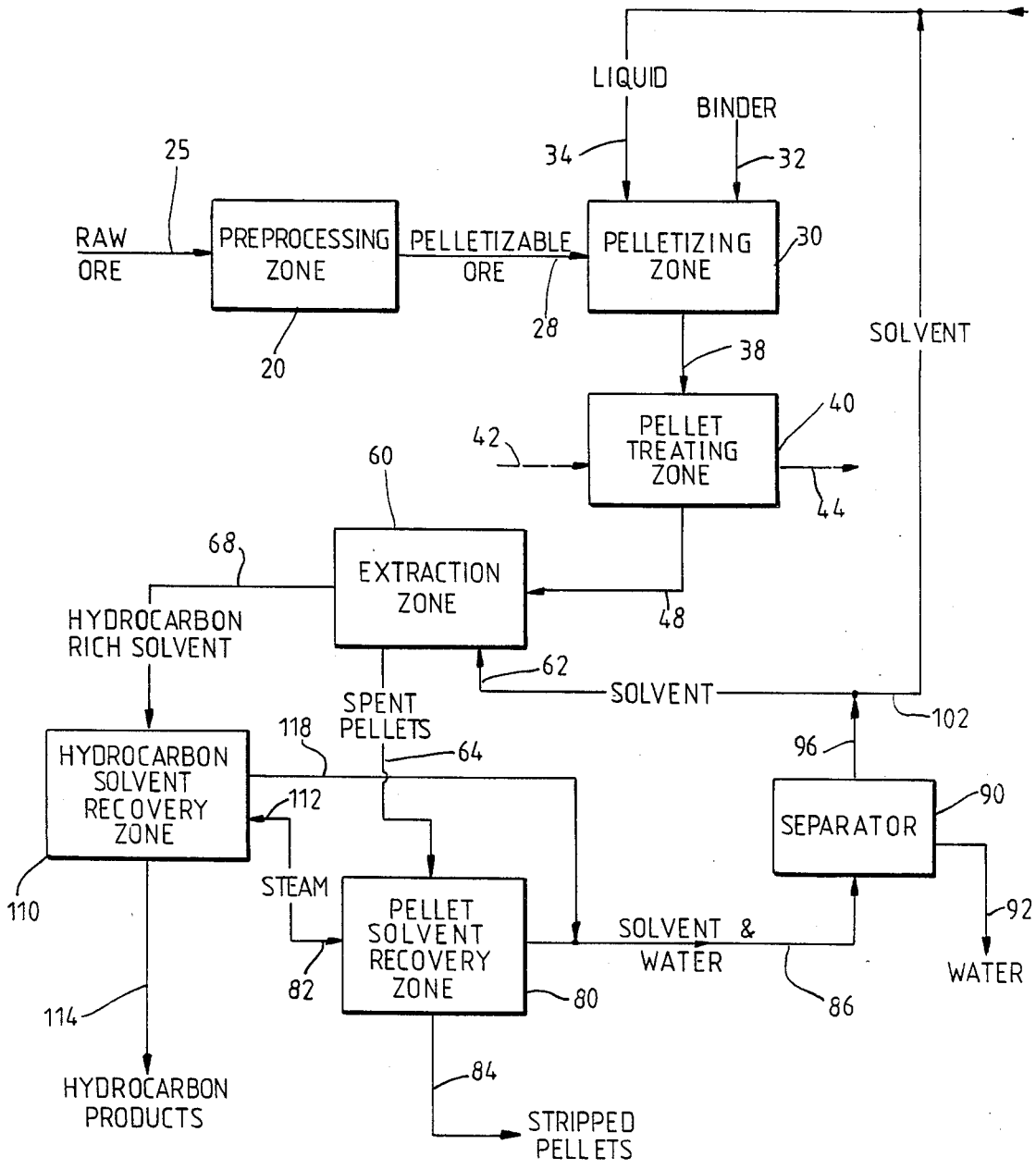
FIG. 1 is a flow chart depicting one embodiment of the present invention.

Referring generally to FIG. 1 there is shown a flow chart of one embodiment of the present invention. Referring generally to that Figure a raw ore passing via line 25 is processed in a preprocessing zone 20 to form a pelletizable ore. This will generally include a reduction in size and may also include other steps necessary to form a pellatizable ore from the raw ore passing via line 25.

The pelletizable ore passes via line 28 to pelletizing zone 30. A liquid, generally water, passes with a binder via line 32 for contact with the pelletizable ore in pelletizing zone 30. The liquid and binder contact the pelletizable ore in such a manner that ore pellets are formed. If the liquid is water it may form a solution with the binder. The solution can then be applied to the pelletizable ore to form pellets. Alternately, a nonaqueous liquid may be passed via line 34. The nonaqueous liquid such as an extracting solvent, may be added to the pelletizable ore prior to applying an aqueous solution of binder to form pellets.

The ore pellets pass via line 38 to pellet setting zone 40, where the pellets are set so as to form extractable ore pellets having sufficient consistency so as to be substantially insoluble in an extracting solvent capable of dissolving hydrocarbons from the hydrocarbon bearing ore.

The extractable ore pellets pass via line 48 to extraction zone 60. Extracting solvent is introduced via line 62 into extraction zone 60. The extracting solvent passing via line 62 is brought into contact with the extractable pellets so that the relative velocity of the solvent to the extractable pellets is sufficient to effectively and efficiently remove hydrocarbons from the extractable pellets.

A hydrocarbon-rich solvent stream passes from the extracting zone 60 via line 68 while spent pellets pass via line 64 to a pellet-solvent recovery zone 80.

The hydrocarbon-rich solvent stream passes via line 68 to hydrocarbon solvent recovery zone 110 where it is brought into contact with steam passing via line 112. A hydrocarbon product is recovered from hydrocarbon-solvent recovery zone 110 via line 114, while a mixed stream of extracting solvent and water passes via line 118 from hydrocarbon-solvent recovery zone 110.

Steam is also passed via line 82 and brought into contact with spent pellets in pellet-solvent recovery zone 80. The resulting solvent and water stream is combined with the solvent and water stream passing in line 118. The combined stream passes via line 86 to separator 90. Stripped pellets are passed via line 84 for disposal or other use as appropriate.

Extracting solvent recovered in separator 90 passes via line 96 while water recovered therefrom passes via line 92. The extracting solvent passing via line 96 may be recycled via line 62 to the extraction zone 60. Alternately and depending upon the composition of the liquid being supplied via line 34 to pelletizing zone 30 the extracting solvent may pass via line 102 to line 34 and hence to pelletizing zone 30. Substantially all or only a portion of the water may be separated in separator 90 depending upon operating conditions in extraction zone 60 and pelletizing and pellet setting zones 30 and 40.

Figure 2:
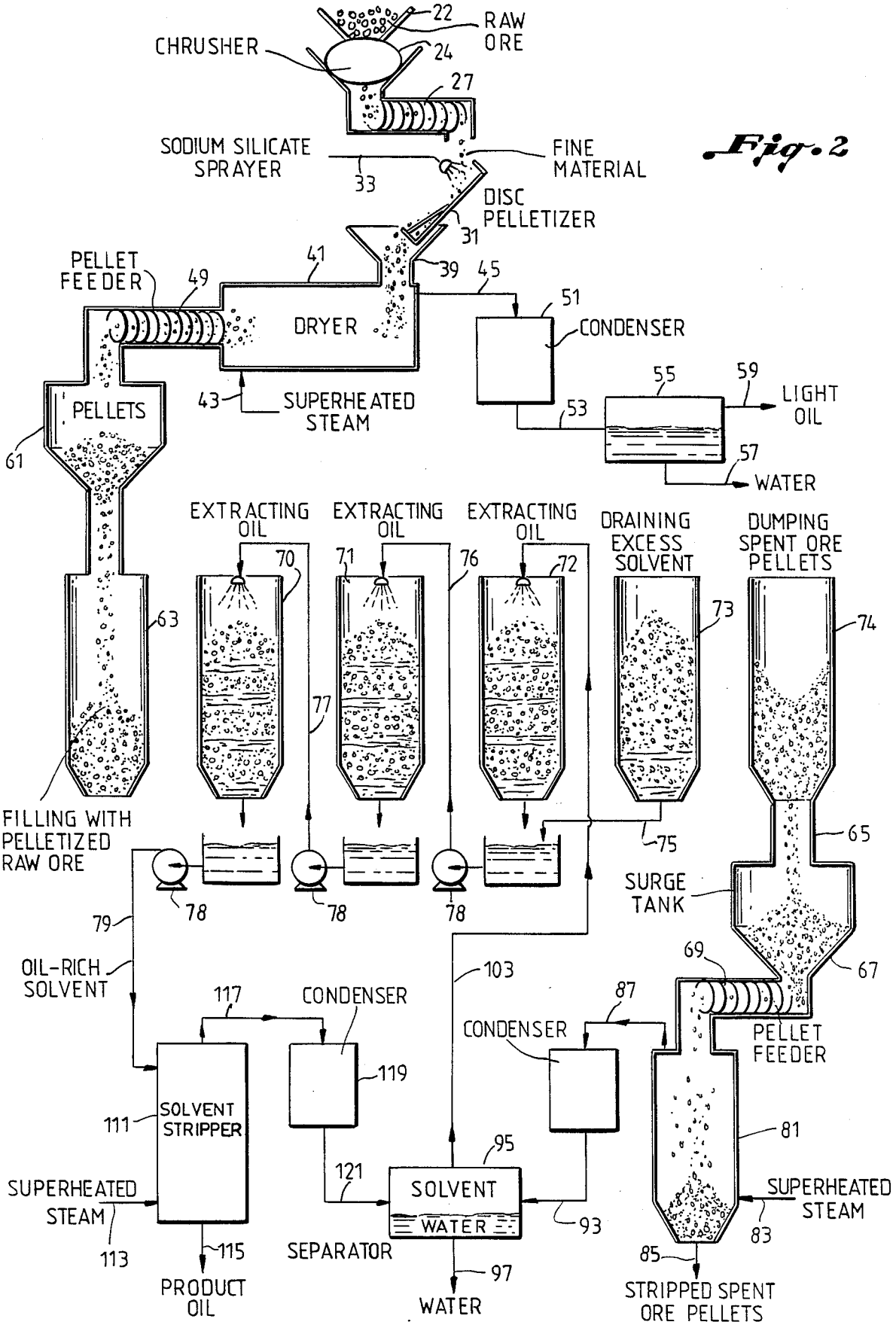
FIG. 2 is a partial schematic view of another embodiment of the present invention.

Referring now to FIGS. 1 and 2, an embodiment of the invention and various modifications thereto will now be described in more detail.

Preprocessing Zone

The raw ore may generally be any solid material with extractable organic material such as hydrocarbons contained therein. To obtain full advantage of all of the features of the process described in conjunction with FIG. 2, the raw ore should also be one which when reduced in size forms a sufficient amount of fines such that a bed of any useful depth will be largely or totally impermeable to an extracting solvent. Examples include oil bearing diatomaceous earth, some tar sands and the like.

It is believed preferable to use a raw ore which is recently mined, since initial experiments indicate that partially oxidized hydrocarbons will generally dissolve more slowly than unoxidized hydrocarbons.

The raw ore passing to the preprocessing zone 20 is processed so as to provide a pelletizable ore for use in the process. Processing requirements in the preprocessing zone will be dictated by overall process conditions, particularly with regard to the method used in pelletizing zone 30 and treating zone 40 to form the pelletizable ore into extractable ore pellets.

The ore should preferably be substantially reduced in size in preprocessing zone 20. The exact size reduction will vary according to process conditions including the type of solvent used and the method employed to form the resulting pelletizable ore into extractable ore pellets. For example, if a diatomite ore is to be employed as the raw ore and the ore pellets are to be formed into pellets by adding a binder comprising an aqueous solution of an N-type sodium silicate followed by drying of the ore pellets at a temperature above about 100° F. to form extractable pellets, then it is believed to be preferable to reduce the size of a significatn portion of the diatomite ore in preprocessing zone 20 to less than about 100 mesh to form a reduced ore.

The percentage of raw ore which is reduced to fines may vary over a wide range without impairing the efficiency of the process. However, the percentage of raw ore so reduced should be such as to facilitate formation of extractable pellets which generally maintain their pellet form after extraction of hydrocarbons and removal of extracting solvent from the pellets.

The preprocessing zone may be comprised of any one or more of several unit operations as would be known to one skilled in the art having the benefit of this disclosure. For example, as shown in FIG. 2 where the ore includes a diatomite ore the preprocessing zone may be made up of a hopper 22 which directs the raw ore into a crusher 24 to form a pelletizable ore.

Pelletizing Zone

Pelletizable ore passes from the preprocessing zone 20 to pelletizing zone 30. For example, as shown in FIG. 2 raw crushed ore may be fed by a raw crushed ore feeder 27 to pelletizing zone 30.

In pelletizing zone 30 ore pellets are formed from the pelletizable ore. As would be known to one skilled in the art having the benefit of this disclosure the pelletizing zone 30 may take on any one of a number of configurations. For example, as shown in FIG. 2 the pelletizing zone 30 may be made up of a disk pelletizer 31. A pelletizable ore such as raw crushed ore passing from feeder 27 could be contacted with a dilute sodium silicate solution passing via sodium silicate sprayer 33. The sodium silicate solution is supplied from the sodium silicate sprayer 33 in sufficient quantity to form ore pellets.

The amount of binder supplied is preferably kept to a minimum sufficient to form pellets which facilitate extraction by improving percolation or permeation and also facilitate draining and disposal of any resulting spent pellets. By way of example, when sodium silicate is used as a binder, the ore pellets are believed to preferably have at least about 0.1 to 3.0 weight percent silicate binder, more preferably about 0.1 to 1.0 weight percent silicate binder and most preferably 0.1 to 0.5 weight percent silicate binder.

Alternately, it is believed a nonaqueous liquid such as an extracting solvent may be added to the pelletizable ore and formed into "balls". A binder solution could then be added with a sufficient amount of fines or crushed recycled pellets to coat the "balls" to form a coating around the "balls". The coating could then be treated in the pellet treating zone.

The use of extracting solvent to initially contact the pelletizable ore to form "balls" followed by the step of coating the "balls" is believed to be advantageous, since it reduces the amount of binder required and allows the extracting process to begin before the pellets enter the extraction zone. Additionally, initial contact with extracting solvent followed by coating with recycled crushed pellets may minimize or even eliminate the need for drying or other subsequent process to set the pellets. It is also believed that by first contacting the ore with extracting solvent, the amount of water in the pellets is limited and the overall extraction process facilitated by reducing the amount of water present in processes downstream of the pelletizing zone.

It is believed generally preferable to make the pellets as small as possible while still facilitating percolation and extraction through a bed of the pellets and allowing efficient disposal of the pellets. For example, the pellets should be large enough to provide an appropriate void volume in the bed of pellets to facilitate permeation of the bed, but not so large as to unduly limit diffusion of extracting solvent into the center of the pellets. However, when extracting solvent is added to form "balls" which are subsequently coated, the size of the pellets may be increased relative to uncoated set pellets due to the presence of extracting solvent in the pellet prior to passage of the pellets to the extracting step.

Thus, the equipment in the pelletizing zone is operated to give pellets of appropriate size. For example, when a sodium silicate solution is used without the addition of extracting solvent, the disk pelletizer 31 and sodium silicate sprayer 33 are believed to be preferably operated such that at least 85% of the pellets have diameters less than about 4 mm, but greater than about 0.1 mm. For example, the sodium silicate sprayer and disk pelletizer could be operated such that the ore pellets have diameters less than about 1.0 mm but greater than about 0.2 mm.

The pelletizing zone may be made up of any one or more of a variety of devices as would be known to one skilled in the art having the benefit of this disclosure. For example, the pelletizing zone may comprise a pin mixer, a ball mill or rotating drums. However, standard commercially marketed equipment should preferably be used. Moreover, it is believed preferable to use a rotating disk since it is believed to provide better control of pellet size and give a better size distribution, while operating at lower cost than other devices.

Pellet Treating Zone

The ore pellets via line 38 to pellet treating zone 40 where the ore pellets are treated so as to form extractable ore pellets. The extractable ore pellets have sufficient consistency so as to be substantially insoluble in the extracting solvent used in the process to dissolve the hydrocarbons from the hydrocarbon bearing ore. This in turn produces several advantages in unit operations downstream of the pellet treating zone 40. For example, the use of extractable ore pellets which are properly treated results in efficient permeation of an extracting solvent through one or more beds of the extractable pellets. Additionally, spent pellets are more easily disposed of and the fines content of various process streams may be reduced.

As would be known to one skilled in the art having the benefit of this disclosure the pellet treating zone may take on anyone of a variety of configurations depending on the configuration of the pelletizing zone 30 and overall process conditions and materials used. As indicated in FIG. 1, it may be appropriate to add one or more substances via line 42 or recover certain substances via line 44. By way of example, as shown in FIG. 2 the pellet treating zone may comprise a dryer 41 supplied with superheated steam via line 43. The superheated steam passes in countercurrent flow through the ore pellets removing water which along with steam passes via line 45 to condenser 51 and from line 53 to oil-water separater 55. A light oil is recovered in oil-water separater 55 and is passed via line 59 as a product of the process, while water is recovered via line 57.

The amount of heat supplied to a dryer will depend upon pellet flow through the dryer and other variables as would be known to one skilled in the art having the benefit of this disclosure. However, the temperature of the pellets should be sufficiently low so as to avoid cracking of the hydrocarbons in the pellets, yet high enough to efficiently set the pellets. For example, where sodium silicate is used in conjunction with a disk pelletizer as generally shown in FIG. 2, the ore is a diatomite ore and the pellets are set by use of superheated steam, the superheated steam passing via line 43 may generally enter at a temperature in the range of about 220° F. to about 550° F. depending upon steam flow rate and other conditions.

In certain cases it is believed that removal of only a small percentage of water from the ore pellets prior to extraction will substantially increase the recovery of hydrocarbons as compared to undried pellets. For example, based on present experimental data, it is believed that when a sodium silicate solution comprising sodium silicate in water is employed as a binding agent that drying of the ore pellets in the pellet setting zone sufficiently to drive off approximately 5% of the water content of the ore pellets results in a substantial increase in the the amount of oil recovered from a diatomite ore.

A variety of other configurations for the pelletizing zone and pellet setting zone may be employed. For example, two disks may be employed in the pelletizing zone with a first disk being used to form the pellets and bring them in contact with a liquid spray such as recycled extracting solvent. The pellets could then be passed to a second disk where they would be sprayed with silicate alone or in combination with other materials. For example, recycled crushed spent pellets or other material could be added to form an outer coating in conjunction with the silicate sprayed on the second disk.

The amount and type of the binder or liquid added may be varied depending upon the equipment used in the pelletizing zone and overall process conditions. However, the binder should be generally insoluble in extracting solvent and the hydrocarbons sought to be extracted, but generally soluble or suspendable as a colloid in water. The binder may be an alkali metal silicate such as a sodium silicate. Alternately, the binder may be made of a starch such as pearl starch. It is also believed that the binder may comprise bentonite, portland cement, quick lime, or a gum such as guar gum. However, a substance such as an asphalt which is soluble in either the extractable hydrocarbons or the extracting solvent is believed to be inoperable in the present process.

A variety of methods may be used in the pellet treating zone to form extractable pellets. It is believed that the pellets may be either chemically or thermally treated. By way of example and not by way of limitation, if sodium silicate is used as a binder then the ore pellets may be formed into extractable pellets by reducing the moisture content of the pellets, by reacting the liquid acting as a solubilizing agent with carbon dioxide or by reacting the sodium silicate with calcium chloride. Alternately, if starch is used as a binder the ore pellets may be set by drying.

The size of the extractable pellets formed in the pelletizing and pellet treating zones may vary over a relatively wide range. However, smaller pellets are believed to be preferable since they have greater strength, and are believed to limit diffusion required within the extractable pellets and so allow a higher concentration of oil in the extracting solvent used in the extraction zone. However, the extractable pellets must be of sufficient size to permit an acceptable permeation rate of the extracting solvent through a bed of the extractable ore pellets in the extraction zone. The pellets should also be of sufficient size such that the spent pellets may be properly disposed of. By way of example, the pellets might be generally on the order of 0.5 to 1.0 millimeters in diameter.

It may also be possible with some ores such as diatomite to use only water, solvent or other liquid in the pelletizing zone 30 to form pellets without a binder being added. However, it is believed that the resulting pellets would have less strength such that the fines content of the hydrocarbon product might increase unacceptably. Further, it is believed that the spent and stripped pellets would be weak. As such, it is believed preferable to add a binding agent such as a sodium silicate or other binders mentioned above.

As indicated, the moisture content of the pellets apparently influences the rate and quantity of hydrocarbon product recovered. For example, it is believed preferable to slightly reduce the moisture content of the pellets when an aqueous sodium silicate solution is employed to obain the best results. By way of example and not by limitation, where a sodium silicate solution is used to form the ore pellets, approximately 4–6% of the weight of the pellets in moisture may be driven off by superheated steam to form the extractable pellets.

Further, based on experimental evidence to date, it is believed that the water content of the extractable pellets should be within a range of greater than about 6% and less than about 34% by weight water and more preferably within a range of about 12% to about 30% by weight water and most preferably within a range of about 18% to 25% weight percent water. However, this range may shift depending upon the nature of the extracting solvent and the temperature at which the extraction is performed.

Extraction Zone

As shown in FIG. 1, the extractable pellets are contacted with an extracting solvent capable of extracting hydrocarbons from the extractable pellets in extraction zone 60.

The extracting solvent may be anyone of a number of solvents. Examples are petroleum distillate, tetrahydrofuran, and methanol. However, as hydrocarbon ores generally contain a wide range of hydrocarbons, it is believed that the solvent may have a relatively broad number of constituents with a wide range of molecular weights and characteristics. It is further believed that molecular structure of the solvent should be preferably reasonably close to the material to be extracted from the ore and have a substantial aromatic portion. For example, a refinery or other process stream may be employed as a source of solvent. However, after start-up of the process the extracting solvent may preferably be a portion of the hydrocarbons recovered.

An appropriate additive or additives may be provided to adjust the characteristics of the extracting solvent if desired. For example, if a solvent stream has a low asphalt solubility relative to the asphaltic hydrocarbon in the ore, then an aromatic hydrocarbon might be added to the solvent to improve its compatibility with the hydrocarbons, depending upon what effects this would have upon other portions of the process.

By way of example, where oil is extracted from a diatomaceous earth, a stream which is high in xylenes and contains some heavier aromatics with little or no toluene or light constituents may be used as a solvent since it should efficiently extract oil from the diatomite ore, yet is believed to be relatively easy to separate from the spent diatomite ore pellets.

The temperature of the extracting solvent entering the extraction zone may vary. In general, its temperature just prior to contacting the extractable pellets is preferably about 120° F. to 200° F. However, the temperature is preferably high enough to efficiently promote extraction of hydrocarbons from the ore, but preferably not so high as to boil off any significant portion of the extracting solvent. In some cases it may be preferable to operate only a few degrees under the boiling temperature of the extracting solvent. In other cases it may be preferable to operate just below the azeotropic boiling point of water and extracting solvent. For example, when diatomite ore is being processed and the extracting solvent is heptane, the extracting solvent may preferably enter the extracting zone in a range of 100° F. to 180° F., is more preferably in the range of about 125° F. to 180° F. and most preferably about 140° F. to 160° F. Thus, the temperature of the extracting solvent passing via line 103 could be 150° F.

The extraction zone may take on one or more of a variety of configurations. However, it must generally allow extracting solvent to pass in substantially even or uniform countercurrent flow through the extractable ore pellets and thereby form a hydrocarbon rich solvent stream. For example, as shown in FIG. 2, the extraction zone 60 may be operated in countercurrent batchwise fashion. Thus, extractable pellets could be passed from dryer 41 by raw ore pellet feeder 49 to hopper 61 and then unloaded into one or more extractors 63, and 70–74. Once each extractor is filled with extractable pellets, the extractable pellets could be contacted with successively leaner streams of extracting solvent containing successively less hydrocarbons. Thus, once an extractor such as 63 is filled with extractable ore an extracting solvent already containing hydrocarbons could pass via line 77 through the fresh extractable pellets as in the case of extractor 70. Thereafter, the extractable pellets could be contacted with extracting solvent containing successively smaller percentages of extracted hydrocarbons in extractors 71 and 72.

After an optimum amount of hydrocarbons are extracted, excess solvent could then be drained from the bed of now spent pellets such as shown in extractor 73. The excess solvent drained from the bed of spent pellets could then be recycled to some portion of the process. For example, as shown in FIG. 2, it could be recycled via line 75 and then pumped via line 76 by pump 78 to extractor 71. Additionally, a portion of the extracting solvent could be supplied to the pelletizing zone.

Once the solvent is drained, the spent ore pellets could be dumped from the extractor, such as shown with respect to extractor 74, to make room for fresh extractable ore pellets.

As would be known to one skilled in the art having the benefit of this disclosure, the extraction zone may take on other configurations. For example, although the extractors 63, and 70–74 are shown as separate units in FIG. 2, the extractors may be combined in one unit to facilitate loading of the extractable pellets, unloading of the spent pellets and distribution of the extracting solvent through the various beds of ore as they pass through the process. For example, it is believed that a stationary basket extractor may be adopted for use in the process. Such a stationary basket extractor with a rotating basket bottom is produced by the French Oil Mill Machinery Co. of Piqua, Ohio.

Operation of the extraction zone should be such as to obtain a hydrocarbon rich solvent stream which has a low ash content. The ash content of the ore is preferably less than about 3 weight percent, more preferably about 1 weight percent and most preferably about 0.2 weight percent or less of the hydrocarbons contained in the hydrocarbon solvent stream.

Additionally, maximum solvent recovery should be obtained when the bed of the spent pellets is drained. By way of example, where a countercurrent batchwise process is used to extract diatomite ore as generally depicted in FIG. 2, the spent pellets should retain less than about 0.75 pounds of extracting solvent per pound of spent pellets when a hydrocarbon extracting solvent is employed, more preferably about 0.5 pounds of extracting solvent per pound of spent pellets and most preferably less than about 0.1 pounds of extracting solvent per pound of spent pellets when a hydrocarbon extracting solvent is employed. For example, 0.2 pounds of extracting solvent may be retained upon draining of diatomite ore pellets. This compares favorably with the solvent extracting of unpelletized crushed diatomite ore which, for example, can retain 2 pounds of solvent per pound of ore processed after a bed of the ore is drained.

As previously indicated, the extractable pellets are formed in such a fashion that effective permeation rates may be obtained. Generally, the relative velocity of the extracting solvent permeating through the extractable ore pellets in the extractors is in the range of about 1 to 10, and more preferably 1 to 5, gallons per square foot per minute. It is believed that a relatively wide range of relative velocities are obtainable with use of the extractable pellets.

Hydrocarbon Solvent Recovery Zone

As shown in FIG. 1, the hydrocarbon rich solvent stream passing via line 68 from extraction zone 60 passes to hydrocarbon solvent recovery zone 110, where the hydrocarbon product is separated off and extracting solvent is recovered for recycle to the process. For example, as shown in FIG. 2, super heated steam passing via line 113 may be brought into countercurrent flow with the hydrocarbon rich solvent such as oil rich solvent passing via line 79 in solvent stripper 111. The hydrocarbon products such as a product oil could pass via line 115 while steam and extracting solvent recovered from the hydrocarbon rich solvent stream could pass via line 117 to condenser 119 and then via line 121 to solvent water separator 95.

As would be known to one skilled in the art having the benefit of this disclosure, a variety of other unit operations could be used in the hydrocarbon solvent recovery zone. However, it is believed that elaborate unit operations are not required, particularly in view of the low ash content and relatively low water content of the hydrocarbon rich solvent stream.

Pellet Solvent Recovery Zone

Spent pellets passing from the extraction zone 60 via line 64 are sent to the pellet solvent recovery zone 80. For example, as shown in FIG. 2 spent pellets are dumped from each successive extractor via conduit 65 to surge tank 67. The spent pellets are then fed via spent ore pellet feeder 69 to pellet stripper 81 where the spent pellets are passed in countercurrent flow with superheated steam passing from line 83. The stripped spent pellets pass via line 85 while steam and recovered solvent pass via line 87 to condenser 91 and from there via line 93 to separator 95.

The process should be operated to obtain a maximum recovery of extracting solvent in pellet solvent recovery zone 80. However, the requirements of solvent recovery zone 80 should be relatively minimal in view of the reduced amount of solvent remaining in the pellets after solvent is drained from the pellets. It is also believed that the spent pellets facilitate solvent recovery as compared to unpelletized spent ore.

It is believed preferable to use steam stripping to recover solvent from the pellets. However, it may be feasible to use a recycled inert gas depending upon various factors including moisture content of the gas.

Extracting solvent recovered from the hydrocarbon rich solvent stream and the spent pellets is recycled to the extraction zone. For example, as shown in FIG. 2 extracting solvent from separator 95 passes via line 103 to extractor 72, while water separated from the extracting solvent is recovered in line 97. As also indicated in FIG. 1 a portion of the extracting solvent may be recycled via line 102 and 34 to pelletizing zone 30 for use in forming "balls" which may be subsequently coated to form extractable pellets.

A variety of variations of the foregoing unit operations and various zones may be accomplished as would be known to one skilled in the art having the benefit of this disclosure.

The following examples are provided to more fully highlight the subject invention. They are provided by way of illustration rather than limitation.

Example 1

Pellets were made with diatomite ore from several drums of material. The ore was screened to obtain a −10 mesh material. The ore was formed into pellets using an N-type sodium silicate (37.6 wt% solids in a clear solution) on a 12-inch diameter laboratory wheel. The ore appeared to form pellets best when it contained between 30 and 40 wt. % moisture. The sodium silicate was diluted, so that when sprayed to give 35 wt. % moisture on the ore, dried pellets would contain 3 wt. % N-type silicate.

Samples of green (moist), air-dried and oven-dried pellets were tested. The green pellets had almost no strength, and deformed when handled. The air-dried pellets had some integrity and the oven dried samples were fairly strong. Crushing strength tests were run on the oven dried pellets only.

Example 2

Pellets were made with diatomite ore. N-type sodium silicate was used and the pellets were formed on a disk having a diameter of about three feet. About 10 pounds of oven-dried pellets, 5 pounds of air-dried pellets and a small sample of green (moist) pellets were collected.

Example 3

Oven dried pellets produced in Example 2 were sieved and each sieve interval extracted separately with toluene column bottoms (TCB) having a general makeup as shown in Table 1, followed by tetrahydrofuran (THF). The tubes had a length of about 4 inches and an inside diameter of approximately ¼ inch.

There was a pressure drop of about ½ psi across the column when pellets were used, and a pressure drop of approximately 100 psi when the raw ore was extracted.

TABLE 1

A PREFERRED SOLVENT FOR EXTRACTION OF ASPHALTIC CRUDE
(Aromatic refinery stream called "Toluene Column Bottoms")

| Component | Mole % |
|---|---|
| Toluene | 30–85 |
| Mixed Xylenes | 12–60 |
| Benzene | 0.5–2 |
| Ethylbenzene | 2–7 |
| Mesitylene | 0.5–7 |

TABLE 2

OIL EXTRACTED FROM EXAMPLE PELLETS

| | | Oil Recovered, wt. % of Feed | | | |
|---|---|---|---|---|---|
| Material | Size | With TCB | With THF* | Total | Max. Oil** Wt. % |
| Pellets | 10 < 18 mesh | 23.9 | 0.7 | 24.6 | 74.2 |

TABLE 2-continued

OIL EXTRACTED FROM EXAMPLE PELLETS

| Material | Size | Oil Recovered, wt. % of Feed: With TCB | With THF* | Total | Max. Oil** Wt. % |
|---|---|---|---|---|---|
| Pellets | 10 < 18 mesh | 24.2 | 0.7 | 24.9 | — |
| Pellets | 18 < 35 mesh | 23.9 | 1.2 | 25.1 | 71.2 |
| Pellets | 35 < 100 mesh | 23.7 | 1.3 | 25.0 | 59.8 |
| Raw Ore | 10 < 325 mesh | 23.2 | 1.8 | 25.0 | 69.2 |

*Recovered with THF (Tetrahydrofuran) following the TCB (Toluene Column Bottoms) extraction.
**Maximum weight percent oil in the TCB.

Based on these results it appears that the effect of pellet size standing alone has only a minimal impact on the amount of oil extracted, at least as long as sufficient permeability rates are obtainable.

Example 4

Dried pellets from Example 2 and a sample of raw ore were sieved. The raw ore had 36 weight percent particles greater than 10 mesh. The raw ore was that which had been fed to the disk pelletizer in Example 2. 59 to 71 weight percent of the resulting pellets from Example 2 were greater than 10 mesh. This indicates that a buildup of larger pellets occurs when wetted ore is rolled over itself, as in a disk pelletizer.

Example 5

Samples of oven-dried and air-dried pellets formed in Example 2 and in a given size range were extracted. The spent pellets were then dried and sieved. Raw ore less than 10 mesh and larger than 325 mesh was also extracted. Extraction was conducted generally as described in Example 2 with TCB followed by THF as extracting solvents.

TABLE 3

SIEVE ANALYSES

| Sieve Range | Raw Ore: Mars Mineral | Raw Ore: Getty | Packed In Tube: Before Extraction | Packed In Tube: After Extraction |
|---|---|---|---|---|
| >10 | 44.7 | 35.8 | 0 | 1.2 |
| 10 > 18 | 5.8 | 16.9 | 26.5 | 33.5 |
| 18 > 35 | 21.2 | 17.0 | 26.6 | 23.6 |
| 35 > 100 | 28.3 | 21.5 | 33.6 | 28.5 |
| 100 > 325 | 28.3 | 8.5 | 13.3 | 11.8 |
| <325 | 28.3 | 0.3 | 0 | 1.4 |

| Sieve Range | Raw Pellets: Oven Dried | Raw Pellets: Air Dried | After Extraction of Sieve Size Interval: 10 > 18 | 18 > 35 | 35 > 100 |
|---|---|---|---|---|---|
| >10 | 59.0 | 71.3 | 1.4 | 0 | 0 |
| 10 > 18 | 23.9 | 18.8 | 94.7 | 0.4 | 0.1 |
| 18 > 35 | 11.0 | 7.5 | 2.9 | 95.0 | 0.5 |
| 35 > 100 | 5.0 | 2.0 | 0.5 | 4.1 | 98.5 |
| 100 > 325 | 1.0 | 0.3 | 0.4 | 0.3 | 0.8 |
| <325 | 0.1 | 0.002 | 0.1 | 0.2 | 0.1 |

The pellets withstood tube extraction with only about 1.5 to 5.3 weight percent of the pellets changing in size. Of those pellets changing in size, the majority were found on the next smaller sieve.

Based on these results (shown generally in Table 3) it appears that the pellets will remain approximately the same size throughout the extraction process. This is apparently so whether the pellets are set by oven drying or air drying where a sodium silicate binder is employed.

Example 6

The ash content of the oil recovered from each run in Example 5 was measured using the first samples collected for each run. The results are set forth in Table 4.

TABLE 4

ASH CONTENT OF EXTRACTED OIL

| Material | Size | Ash Content, wt. % of Oil: First Sample | Overall |
|---|---|---|---|
| Pellets | 10 < 18 mesh | 0.46 | 0.31 |
| | 10 < 18 mesh | 0.45 | 0.25 |
| | 18 < 35 mesh | 0.39 | 0.30 |
| | 35 < 100 mesh | 0.45 | 0.39 |
| Raw Ore | 100 < 325 mesh | 0.19 | 0.31 |

The raw ore is believed to act as its own filter, resulting in a low ash conent for oil recovered from the raw ore. As expected the oil recovered from the raw ore had a low ash content. However, oil recovered from the pellets also had a low ash content with the 10 to 35 mesh pellets apparently resulting in an ash content less than or equal to the oil recovered from unpelletized raw ore.

Example 7

The crushing strength was measured for 20 pellets from each size range. These pellets were formed from ore on a 3-feet diameter commercial size disk as in Example 2. Both raw and extracted pellets were tested. Most of the tests were with oven dried pellets with one test on air dried pellets. Select results are shown in Table 5. Spent pellets preferably have a crush strength of at least about 10 psi.

TABLE 5

CRUSHING STRENGTH OF PELLETS

| Condition | Mesh | Crushing Strength, psi: Unextracted | Extracted |
|---|---|---|---|
| Air Dried | 10 < 18 | 18 | — |
| Oven Dried | 10 < 18 | 78 | 23 |
| Oven Dried | 18 < 35 | 171 | 38 |
| Oven Dried | 35 < 100 | 169 | — |

Most of the air dried pellets deformed, rather than shattered. The harder the pellet, the smaller the particles it seemed to shatter into upon failure. It is believed that in general the pellet strength is greater than what is necessary to control attrition during transport for disposal.

Example 8

Density

The bulk density of the ore and pellets from Example 2 was determined by the weight of material required to fill a 50 cc graduate. Also, the individual pellet density was calculated by measuring the diameter of 50 pellets with a microscope. The average diameter was used to calculate the volume of the average pellet, which was divided into the total weight of the 50 pellets. All samples were oven dried. The results are given in Table 6.

TABLE 6

DENSITY OF ORE AND PELLETS

| Material | Bulk Density, g/cc: Unextracted | Extracted | Individual Pellets, g/cc: Unextracted | Extracted |
|---|---|---|---|---|
| Raw Ore | 0.627* | 0.501 | — | — |

TABLE 6-continued

| DENSITY OF ORE AND PELLETS | | | | |
|---|---|---|---|---|
| | Bulk Density, g/cc | | | |
| Material | Unextracted | Extracted | Individual Pellets, g/cc Unextracted | Extracted |
| Pellets: | | | | |
| 10 < 18 mesh | 0.535 | 0.381 | 0.750 | 0.563 |
| 18 < 35 mesh | 0.545 | 0.394 | 0.692 | 0.423 |
| 35 < 100 mesh | 0.534 | 0.403 | 0.713 | 0.462 |

*The density of the wet raw ore is 0.756 g/cc.

The density of the actual pellets is greater than the dry ore. This may be due to compaction during pelletizing, or the presence of moisture in the pellets.

The biggest density change between raw and pelletized ore appears to be in bulk density. It appears that the pellets pack like spheres, creating porosity (void volume) in addition to the internal pellet porosity. Based on bulk density of raw and pelletized ore, a given weight of dry pellets will occupy 14.2% more volume than the same weight of dry ore.

Example 9

Several barrels of ore which passed through a No. 10 mesh were collected. This ore was very wet, averaging 24 weight percent moisture. It was also very rich in hydrocarbons. The ore was pelletized, ending up with 32 to 36 weight percent water and approximately 1 weight percent N-type sodium silicate. The silicate binder was set by: (1) reducing its moisture content by drying, (2) reacting the silicate solubilizing agent with an acid gas, $CO_2$, and (3) reacting the sodium silicate with a calcium chloride solution, forming the cement-like calcium silicate. The extractable pellets contained from 4.3 to 36 weight percent water.

Example 10

Extraction tests were conducted using s small pilot extractor and the pellets formed in Example 9. The pilot extractor comprised a 6-inch by 6-inch steel column, 72-inches high, with glass view ports along the entire length. A screw conveyor was used to charge fresh material to the extractor. After extraction, the column was inverted, and the same screw conveyor used to remove the spent material. There were 6 separate 12 gallon tanks for fresh solvent, or solvent-oil mixtures. The pumping system permitted feed to the column from any tank, and also allowed flow from the column to be pumped to any selected tank. The system was equipped with steam heat-exchangers, so the solvent could be heated and extractions made at controlled elevated temperatures. The pilot facility also had units to strip solvent off spent material, and to strip solvent from extracted oil.

Thirteen tests were run. The extracting solvent for all tests was Amsco 1483 solvent from Union Chemicals in Middletown, Ohio. This was a commercial heptane fraction, the composition of which will vary somewhat depending upon source. This is not believed to significantly affect results.

The first pellets tested from those made in Example 9 had a nominal 4.3% moisture. A sieve analysis of the dried pellets showed almost 1% smaller than 100 mesh, and 4% larger than 6 mesh. Therefore all the pellets were sieved before being used. Only pellets less than 6 mesh and greater than 100 mesh were charged to the extractor. From a plot of the sieve results, the 50 weight percent size of the 4.3% moisture pellets was 0.90 mm, or about 19 mesh.

Two initial tests were made at room temperature. These were primarily to familiarize the operators with the plant and with how it operated with a diatomite ore. A 30-inch column of pellets was used. Results appeared reproducible. The next 11 runs were made at 125° and 180° F., with 30-inch and 60-inch columns, and with different moisture content pellets.

Four of the runs were made with nominal 18% moisture content pellets. A plot of the sieve analysis indicated a very slightly larger 50 weight percent size, 0.95 mm. The $CO_2$ and $CaCl_2$ cured pellets had much larger average size, and also tended to form chunks. Two tests were made, using ore from each of these barrels. They had average moisture contents of 34 weight percent.

The results of Runs 5–7 and 9–13 are set out in Table 7. The pellets were made with Pit II ore, with 1 weight percent Type-N sodium silicate binder.

TABLE 7

| Run Number | Temperature °F. | Moisture Content wt % | Recovered Oil wt % (moisture free) |
|---|---|---|---|
| 5 | 180 | 4.3 | 22.6 |
| 6 | 180 | 4.3 | 22.8 |
| 7 | 125 | 4.3 | 19.4 |
| 9 | 125 | 18.0 | 22.2 |
| 10 | 180 | 18.0 | 21.6 |
| 11 | 125 | 34.0 | 16.1 |
| 12 | 180 | 18.0 | 22.3 |
| 13 | 125 | 38.0 | 11.9 |

Based on the results of the tests conducted in Example 10, it appears a column of the pellets is sufficiently permeable for efficient use of the process. Percolation rates ranged from about 0.9 to about 7.1 gal/min-ft$^2$.

Use of the process will also apparently result in a hydrocarbon product having a low ash content. Test results on runs 1–13 revealed ash contents ranging from 0.07 to 0.40 weight percent for an average of about 0.17 weight percent of the hydrocarbon product.

The moisture content of the pellets affects the rate and quantity of oil recovery. Thus, based on the results of runs 1–13 the percent of total oil extracted at a given volume of solvent through the column showed only minor variations for 6 or 18% water, at 125° or 180° F. However, at 34% water, the rate of oil extraction (per volume) was less.

In a somewhat similar vein the percent of total oil extracted at a given time of flow showed only minor variations for 18% or 34% water, at 125° or 180° F. However, at 6% water, the rate of oil extraction (per unit time) was less.

The total fraction of the ore recovered as oil (on a moisture free basis) showed what appears to be a marked dependence on water content. The 18% water pellets had the most oil recovered, while both ends of the spectrum, 6% and 34%, showed lower total extraction at 125° F. At 180° F., the oil recovery at 6 and 18% agreed.

Example 11

Eight additional runs (Runs 14–21) were conducted using the same pilot plant set up as in Example 10. The results are shown in Tables 8–14. Pellets were prepared with 1% silicate binder, and with water only. The ore was from Pit II, identified as Master composite Sample #4 (MSC #4).

TABLE 8

NOMINAL TEST CONDITIONS

| Run Number | Silicate Binder | Bed Depth | Moisture Content, wt % | Temp. °F. | Cycle |
|---|---|---|---|---|---|
| 14 | No(1) | 2 ft | 30.5 | 180 | 1(3) |
| 15 | No | 2 ft | 30.5 | 180 | 1 |
| 16 | Yes(2) | 5 ft | 33.0 | 180 | 1 |
| 17 | Yes | 5 ft | 33.0 | 125 | 1 |
| 18 | No | 5 ft | 30.5 | 125 | 2(4) |
| 19 | Yes | 5 ft | 28.1 | 180 | 2 |
| 20 | Yes | 5 ft | 20.3 | 125 | 2 |
| 21 | No | 5 ft | 30.5 | 180 | 2 |

(1)Pellets with water only.
(2)Pellets with water and sodium silicate; silicate equals 1 wt % of final pellets.
(3)Flooded column; 1 minute drainage between stages; 5 stages; 1 hr. total time. Amsco 1483 used as extracting solvent.
(4)Continuously flooded column; no drainage between stages.

TABLE 9

ACTUAL RUN CONDITIONS

| Run Number | Bed Depth, in.(1) Start | End | Feed, Pounds | Moisture wt % | Temperature, °F. In | Out |
|---|---|---|---|---|---|---|
| 14 | 25 | 23½ | 24⅛ | 30.5 | 170–184 | 122–156 |
| 15 | 26 | 24¾ | 26¼ | 30.5 | 180–182 | 147–150 |
| 16 | 66½ | 63 | 66 | 33.0 | 176–180 | 145–148 |
| 17 | 66½ | 63½ | 66 9/16 | 33.0 | 125–135 | 105–120 |
| 18 | 65½ | — | 65½ | 30.5 | 120–132 | 107–118 |
| 19 | 66¾ | 66½ | 66 | 28.1 | 176–183 | 121–151 |
| 20 | 56 | 55¼ | 55 1/16 | 20.3 | 122–130 | 101–111 |
| 21 | 68½ | 64½ | 67 11/16 | 30.5 | 177–188 | 140–148 |

(1)Column was 6 inches square with five 12 inch long sight glasses on front face.

TABLE 10

BULK DENSITY AND SHRINKAGE

| Run Number | Initial Bed Depth, in. | Bulk Density(1) lb/cf | g/cc | Shrinkage,(2) or Compaction, % |
|---|---|---|---|---|
| 14 | 25 | 46.3 | 0.743 | 6.0 |
| 15 | 26 | 48.5 | 0.777 | 4.9 |
| 16 | 66½ | 47.6 | 0.764 | 5.3 |
| 17 | 66½ | 48.0 | 0.770 | 4.5 |
| 18 | 65½ | 48.0 | 0.770 | — |
| 19 | 66¾ | 47.5 | 0.761 | 0.4 |
| 20 | 56 | 47.2 | 0.757 | 1.3 |
| 21 | 68½ | 47.4 | 0.760 | 5.8 |

(1)Based on initial bed depth and weight of feed.
(2)Based on change between initial and final column bed depths.

TABLE 11

OIL RECOVERED

| Run Number | Conditions Depth | Binder | Moisture | Temp | Cycle | Oil Recovered, wt % |
|---|---|---|---|---|---|---|
| 14 | 25 | No | 30.5 | 180 | 1 | 11.1 |
| 15 | 26 | No | 30.5 | 180 | 1 | 10.3 |
| 16 | 66½ | Yes | 33.0 | 180 | 1 | 13.6 |
| 17 | 66½ | Yes | 33.0 | 125 | 1 | 13.1 |
| 18 | 66½ | No | 30.5 | 125 | 2 | 9.3 |
| 19 | 66 | Yes | 28.1 | 180 | 2 | 19.4 |
| 20 | 56 | Yes | 20.3 | 125 | 2 | 19.4 |
| 21 | 68½ | No | 30.5 | 180 | 2 | 12.8 |

TABLE 12

ASH CONTENT OF RECOVERED OIL

| Run Number | Binder | Ash Content, wt % of Oil First Out(1) | Richest Solvent(2) |
|---|---|---|---|
| 14 | No | 5.1 | 0.13 |
| 15 | No | 1.58 | 0.18 |
| 16 | Yes | 0.58 | 0.06 |
| 17 | Yes | 0.21 | 0.09 |

TABLE 12-continued

ASH CONTENT OF RECOVERED OIL

| Run Number | Binder | Ash Content, wt % of Oil First Out(1) | Richest Solvent(2) |
|---|---|---|---|
| 18 | No | 0.29 | 0.0 |
| 19 | Yes | 0.80 | 0.0 |
| 20 | Yes | 1.43 | 0.04 |
| 21 | No | — | — |

(1)The first liter of rich solvent was sampled after it percolated through the ore, the solvent evaporated, and the oil was ashed.
(2)At the end of the test, the tank of richest solvent was recirculated for 5 minutes, a sample obtained, and solvent evaporated to recover the oil. This oil was then ashed.

TABLE 13

SOLVENT HOLDUP IN COLUMN

| Run Number | Binder | Oil Recovered, wt % (MF) | Solvent(1) Hold-up, % |
|---|---|---|---|
| 14 | No | 11.1 | 56 |
| 15 | No | 10.3 | 58 |
| 16 | Yes | 13.6 | 23 |
| 17 | Yes | 13.1 | 38 |
| 18 | No | 9.3 | 36 |
| 19 | Yes | 19.4 | 50 |
| 20 | Yes | 19.4 | 48 |
| 21 | No | 12.8 | 27 |

(1)Pounds of solvent retained in pellet bed per pound of dry, desolventized spent pellets (silica plus unrecovered oil).

TABLE 14

PERCOLATION RATES(1)

| Run Number | Flow Rates, in Gallon/Min-ft² Initial | Stage 4 | Stage 3 | Stage 2 | Stage 1 | Rinse | Final |
|---|---|---|---|---|---|---|---|
| 14 | 7.3 | 6.0 | 2.6 | 1.7 | 1.4 | 1.2 | 1.2 |
| 15 | 7.9 | 4.9 | 3.2 | 2.4 | 1.2 | 0.5 | 0.5 |
| 16 | 9.1 | 7.8 | 5.2 | 3.8 | 2.9 | 2.8 | 2.7 |
| 17 | 8.5 | 8.8 | 6.0 | 5.1 | 4.8 | 4.3 | 3.9 |
| 18 | 7.2 | 6.9 | 5.5 | 4.7 | 3.9 | 4.1 | 3.9 |
| 19 | 5.3 | 5.3 | 4.5 | 3.1 | 2.1 | 1.3 | 1.3 |
| 20 | 2.6 | 3.0 | 2.9 | 2.8 | 3.1 | 2.8 | 2.8 |
| 21 | 6.3 | 5.5 | 4.4 | 2.8 | 1.5 | 1.1 | 0.9 |

(1)Percolation rates dropped off in the "drained" cycle tests due to gas saturation build up. This indicates that the temperature should preferably be controlled to minimize the solubiltiy of any air in the solvent.

Based on the foregoing test results, it is believed that a hydrocarbon ore in conjunction with a sufficient amount of fines may be formed into pellets. Given proper pellet size, moisture content and strength, it should be both feasible and advantageous to extract a low ash hydrocarbon product from the ore with efficient recovery and recycle of extracting solvent and efficient disposal of the spent pellets. For example, as indicated by the foregoing discussion and examples for a diatomite ore process described in conjunction with FIG. 2, contact of extracting solvent with the hydrocarbon ore is facilitated by forming the ore into pellets and driving off a minimal amount of water from the pellets. Additionally, greatly enhanced solvent recovery occurs by improved drain off from the pellet ore bed. The spent pellets maintain their strength sufficiently for easy disposal, while the hydrocarbon product has a greatly reduced fines content. No emulsions of any significance are formed and oil and water separation are kept to a minimum.

Although the foregoing examples as well as a large part of the foregoing discussion have been mainly directed to the use of the invention in connection with the extraction of an oil bearing diatomaceous earth or diatomite ore, it should be understood that the invention can also be used to advantage in conjunction with the extraction of hydrocarbons from a variety of hydrocarbon containing ores, particularly where the ores form at least a portion of fines upon being reduced in size.

Further modifications and alternative embodiments of the inventive method and apparatus will be apparent to those skilled in the art having the benefit of this disclosure. Accordingly, this description and the examples are to be construed as illustrative only and for the purpose of teaching those skilled in the art the manner of carrying out the invention according to the patent statutes. For example, equivalent materials may be substituted for those specifically illustrated and described herein and certain features of the invention may be utilized independently of the use of other features. All this would be apparent to one skilled in the art after having the benefit of this description of the invention.

What is claimed is:

1. A process for recovering hydrocarbons from a diatomite ore comprising the steps of:

reducing the size of the ore to less than about 5 mesh to form a reduced ore;

combining the reduced ore with liquid to form ore pellets;

treating the ore pellets to form extractable ore pellets, said extractable ore pellets having sufficient consistency so as to be substantially insoluble in an extracting solvent capable of dissolving hydrocarbons from the hydrocarbon bearing ore and so minimize the release of fines from the pellets, and said extractable pellets being of sufficient size, surface area and moisture content so as to facilitate extraction of the hydrocarbons from a bed of the extractable pellets upon contact of the extractable pellets with the extracting solvent;

contacting a bed of the extractable pellets with extracting solvent in an extraction zone such that the relative velocity of the solvent to the extractable pellets is at least about one-half gallon per square foot per minute or more to thereby extract hydrocarbons from the extractable pellets and form spent pellets and a hydrocarbon rich solvent stream comprising extracting solvent and extracted hydrocarbons, said extracted hydrocarbons having an ash content of about less than 3 weight percent; and recovering extracting solvent from the spent pellets while retaining the spent pellets in pellet form without release of a significant amount of fines.

2. A process for recovering hydrocarbons from a diatomite ore comprising the steps of:

reducing the size of the ore to less than about 5 mesh with a significant fraction less than 100 mesh to form a reduced ore;

forming ore balls from the reduced ore by adding water or an at least partially nonaqueous liquid comprising extraction solvent;

forming ore pellets from the ore balls by contacting the balls with a binder;

treating the ore pellets to form extractable ore pellets, said extractable ore pellets having sufficient consistency so as to be substantially insoluble in an extracting solvent capable of dissolving hydrocarbons from the hydrocarbon bearing ore and so minimizing the release of any fines from the pellets and of sufficient size, surface area, and moisture content so as to facilitate extraction of the hydrocarbons from the extractable pellets upon contact of the pellets with extracting solvent;

contacting the extractable pellets with extracting solvent in an extraction zone such that the relative velocity of the solvent to the extractable pellets is at least about one gallon per square foot per minute or more to thereby extract hydrocarbons from the extractable pellets and form a hydrocarbon rich solvent stream comprising extraction solvent and extracted hydrocarbons, said extracted hydrocarbons having an ash content of about less than 3 weight percent, spent pellets, said spent pellets retaining less than about 0.75 pounds of extracting solvent per pound of spent pellets after draining any liquids from the spent pellets; and recovering extracting solvent from the spent pellets while retaining the spent pellets in pellet form without release of a significant amount of fines.

3. A process according to claim 2 wherein the binder comprises an aqueous solution of sodium silicate.

4. A process according to claims 1 or 2 wherein the step of treating the ore pellets comprises drying the ore pellets at above about 100° F. whereby the extractable pellets have a water content in the range of about 6 to 34 weight percent based on the weight of the pellets.

5. A process according to claim 4 wherein the extractable pellets have a water content in the range of about 18 to 25 weight percent based on the weight of the pellets.

6. A process according to claims 1 or 2 wherein a binder comprising sodium silicate is used to form the ore pellets and the step of treating the ore pellets comprises exposing the ore pellets to carbon dioxide or other acidic materials in sufficient quantity to set the pellets.

7. A process according to claim 1 wherein a binder comprising sodium silicate is used to form the ore pellets and the step of treating the ore pellets comprises reacting the silicate with calcium chloride in sufficient quantity to set the pellets.

8. A process according to claims 1 or 2 wherein the extracting solvent comprises a petroleum distillate.

9. A process according to claims 1 or 2 wherein the relative velocity of the extracting solvent to the extractable ore pellets is in the range of about 0.5 to 10 gallons per square foot per minute.

10. A process according to claims 1 or 2 wherein the step of recovering extracting solvent from the spent pellets comprises the step of steam stripping the pellets.

11. A process according to claims 1 or 2 wherein at least a portion of the extracting solvent is recycled to the extraction zone.

12. A process according to claims 1 or 2 wherein the extracting solvent is at a temperature of at least about 120° F. just prior to contacting the extractable pellets.

13. A process according to claim 12 wherein the temperature of extracting solvent is in the range of about 120° to 200° F. just prior to contacting the extractable pellets.

14. A process according to claims 1 or 2 wherein the spent pellets have a crush strength of at least about 10 pounds per square inch.

15. A process according to the claims 1 or 2 wherein the pellets are disposed of in pellet form without formation of a substantial amount of fines.

16. A process according to claim 3 wherein the binder comprises an N-type sodium silicate solution comprising about 30 to 40 weight percent solids.

17. A process according to claims 1 or 2 wherein the pellets are formed by spraying the reduced ore on a rotating disk with a solution of the binder.

18. A process for receiving hydrocarbons from a diatomite ore comprising:

crushing the ore to form a reduced ore;

applying an aqueous binder solution to the reduced ore to form ore pellets;

treating the ore pellets to form extractable ore pellets at least 85% of which have diameters in the range of approximately 0.1 to 4 millimeters, said extractable ore pellets having sufficient consistency so as to release little or no fines into an extracting solvent contacting the extractble ore pellets;

passing an extracting solvent through a bed of the extractable ore pellets in an extraction zone to allow sufficient contact between the extractable ore pellets and the extracting solvent to thereby form a hydrocarbon rich solvent stream comprising extracting solvent and hydrocarbons and spent pellets;

draining extracting solvent from the spent pellets such that the spent pellets have less than about 0.5 pounds of solvent retained per pound of pellets;

recovering retained extracting solvent from the spent pellets;

recovering extracting solvent from the hydrocarbon rich solvent stream to form a hydrocarbon product stream with an ash content of less than 3 weight percent;

recycling at least a portion of the recovered extracting solvent to the extraction zone for contact with the extractable ore pellets.

19. A process for recovering hydrocarbons from a diatomite ore comprising the steps of:

reducing the size of the diatomite ore to less than 5 mesh, with a significant portion less than about 100 mesh to form a reduced ore;

forming ore pellets from the reduced ore by adding an aqueous liquid and a binder comprising N-type sodium silicate to the reduced ore, said water and binder being added in sufficient quantities to form an ore pellet having about 0.5 to 3.0 weight percent sodium silicate and about 20 to 36 weight percent water;

treating the ore pellets by drying the ore pellets at a temperature above about 100° F. to form extractable pellets having a weight percent of water in the range of about 6% to 34% and a size generally in the range of 0.1 to 4.0 millimeters;

forming the extractable pellets into at least one extractable pellet bed in an extraction zone;

passing an extracting solvent capable of extracting hydrocarbons from the diatomite ore upwardly through the extractable pellet bed, said extracting solvent being at a temperature of at least about 100° F. upon contacting the bed and flowing at a rate in the range of about 1 to about 10 gallons per square foot per minute through the bed to thereby extract hydrocarbons from the extractable pellets and form spent pellets and a hydrocarbon rich solvent stream comprising extracted hydrocarbons and solvent;

recovering extraction solvent from the hydrocarbon rich solvent stream to form a first extraction solvent recycle stream and a hydrocarbon product stream having an ash content of about less than 3 weight percent;

discontinuing the flow of extraction solvent through the bed of extractable pellets once at least approximately 75% of the hydrocarbons have been recovered and the pellets are spent;

draining residual extraction solvent from the bed of spent pellets such that the pellets retain less than about 0.75 pounds of extracting solvent per pound of spent pellets;

steam stripping extraction solvent from the spent pellets to form a second extraction solvent recycle stream comprising extraction solvent stripped from the spent pellets while retaining the spent pellets in pellet form;

recycling at least a portion of either or both of the first and second recycle solvent streams to the extraction zone after removing at least a portion of any water mixed in the portion of the first and second recycle solvent streams recycled.

20. A process according to claim 19 further comprising the step of disposing of the spent pellets in pellet form.

21. A process according to claim 19 wherein the reduced ore is first contacted with an extracting solvent to form reduced ore balls and thereafter contacted with the aqueous liquid and binder to form ore pellets.

22. A process according to claims 19 or 21 wherein the extracting solvent comprises a petroleum distillate.

23. A process according to claim 19 wherein the extracting solvent comprises tetrahydrofuran.

24. A process according to claim 19 wherein the extracting solvent comprises methanol.

25. A process according to claim 19 wherein the step of forming the ore pellets is accomplished at least in part on a rotating disk type pelletizer.

26. A process according to claim 19 wherein the weight percent sodium silicate in the ore pellets is approximately 0.1 to 1%.

27. A process according to claim 19 wherein the extractable pellets have a weight percent of water in the range of about 12% to about 30%.

28. A process according to claim 27 wherein the extracting solvent is at a temperature in the range of about 125° F. to about 180° F. and the extractable pellets have a weight percent of water in the range of about 18 to 25%.

29. A process according to claim 28 wherein the extracting solvent is at a temperature of between about 140° F. and 160° F.

30. A process according to claim 19 wherein more than one extractable bed is formed and wherein the extracting solvent is fed in batchwise countercurrent flow through the beds of extractable pellets.

31. A process according to claim 19 wherein the extracting solvent flows at a rate in the range of about 1 to 5 gallons per square foot per minute through the bed.

32. A process according to claim 19 wherein the hydrocarbon product stream has an ash content of about less than 1 weight percent.

33. A process according to claim 19 wherein the spent pellets retain approximately 0.5 pounds of extracting solvent per pound of spent pellets upon draining of the bed.

34. A process according to claim 33 wherein the spent pellets retain less than approximately 0.1 pounds of extracting solvent per pound of spent pellets upon draining of the bed.

* * * * *